United States Patent [19]

Jones

[11] 3,950,273

[45] Apr. 13, 1976

[54] MEDIUM TEMPERATURE THERMISTOR

[75] Inventor: Colin Stanley Jones, Taunton, England

[73] Assignee: International Standard Electric Corporation, New York, N.Y.

[22] Filed: July 5, 1973

[21] Appl. No.: 376,501

[30] Foreign Application Priority Data

July 6, 1972 United Kingdom ..... 31673/72

[52] U.S. Cl. ..... 252/517; 252/518; 252/520; 252/521

[51] Int. Cl.[2] ..... H01C 1/00

[58] Field of Search ..... 252/521, 520, 518, 517; 338/22 R

[56] References Cited

UNITED STATES PATENTS 3,235,655 2/1966 Counts et al. ..... 252/521

OTHER PUBLICATIONS

*Ionic and Electronic Conductivity of Zirconium Oxide—$PrO_{1.83}$ Systems*, Chemical Abstracts, 1968, Vol. 68, No. 108453t.

*Electrical Conductivity of Solid Oxide Systems*, Chemical Abstracts, "The $ZrO_2$–$PrO_{1.83}$ System," Vol. 67, 1967, No. 47755.

*Zirconia–Praseodymium Oxide and Zirconia–Terbium Oxide Systems at Elevated Temperatures*, Chemical Abstracts, Vol. 69, 1968, No. 13330.

*Primary Examiner*—Maynard R. Wilbur
*Assistant Examiner*—H. A. Birmiel
*Attorney, Agent, or Firm*—John T. O'Halloran; Menotti J. Lombardi, Jr.; Alfred C. Hill

[57] ABSTRACT

A thermistor material of between 99% and 50% by weight of praseodymium oxide and 1 to 50% by weight of zirconium oxide provides a stable thermistor with desired resistance value changes over a temperature range of 100°C to 600°C. Other selected oxides may be used in place of zirconium. Small amounts of indium or gallium oxides can also be added to the mixture to lower the resistivity and temperature coefficient of resistance.

8 Claims, 2 Drawing Figures

Fig. 1. RESISTANCE-TEMPERATURE RELATIONSHIP FOR A BEAD THERMISTOR MADE FROM 80% $Pr_6O_{11}$. 20% $ZrO_2$ - A
90% $Pr_6O_{11}$. 10% $ZrO_2$ - B
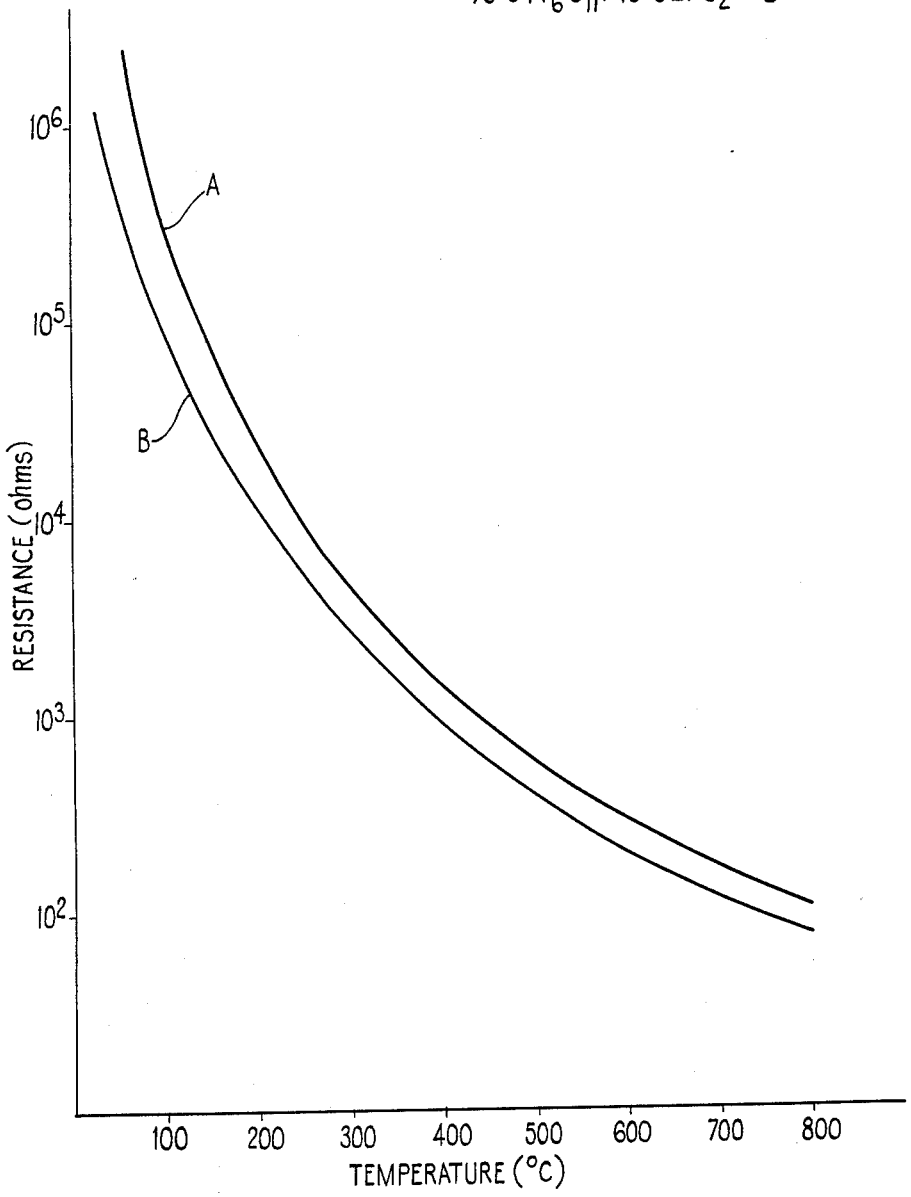

Fig. 2. RESISTANCE - COMPOSITION RELATIONSHIP FOR BEAD THERMISTORS PREPARED FROM MIXTURES OF PRASEODYMIUM OXIDE AND ZIRCONIUM DIOXIDE
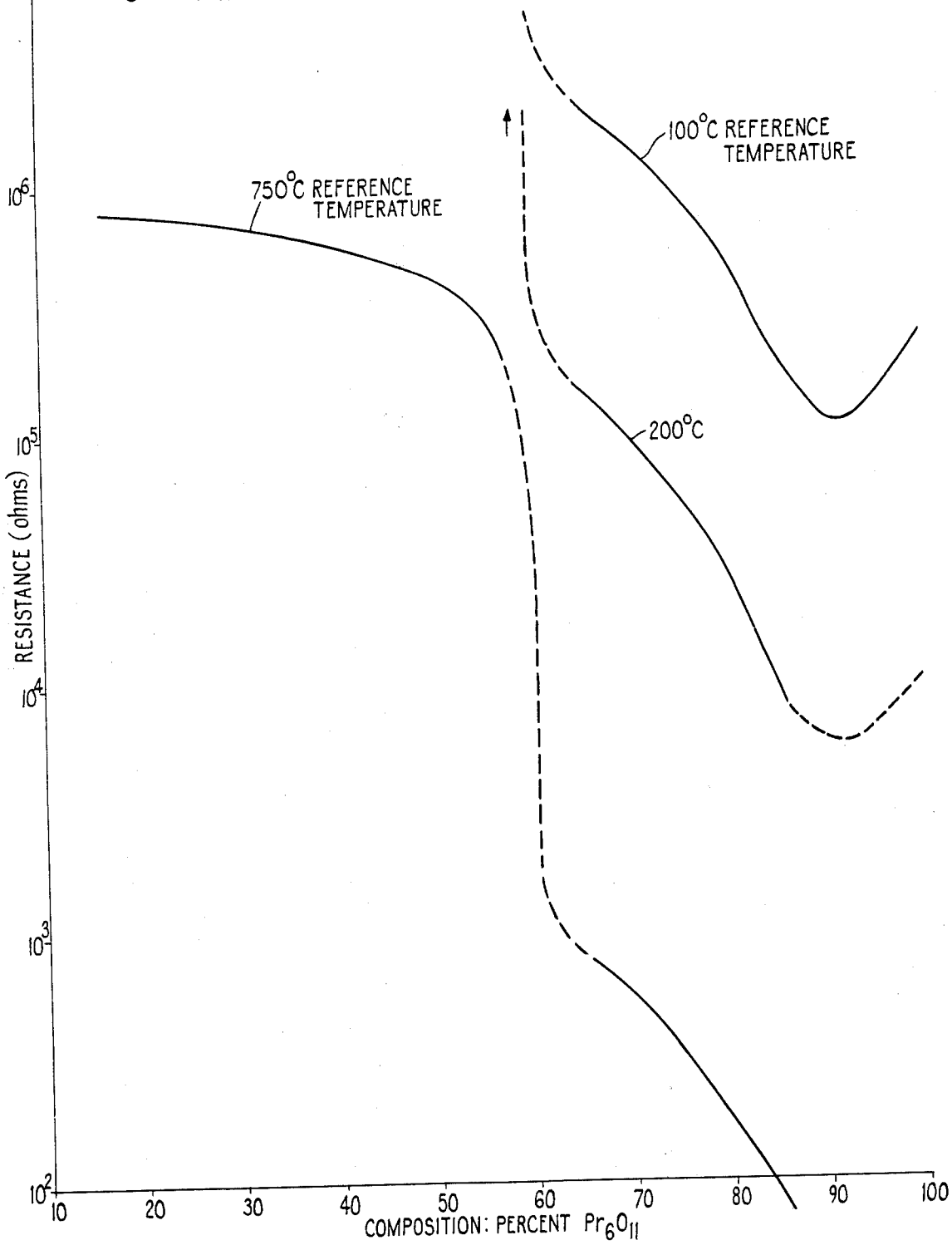

MEDIUM TEMPERATURE THERMISTOR

BACKGROUND OF THE INVENTION

1. Field of the Invention

This invention relates to thermistors and is particularly concerned with thermistor materials suitable for use over a medium temperature range lying between the range covered by normal thermistors and high temperature thermistors.

2. Description of the Prior Art

Thermistors are thermally-sensitive resistors. They may have either a positive or negative coefficient of resistance depending on such factors as composition and thermal treatment. Normal negative temperature coefficient (NTC) thermistors commercially available generally cover the temperature range −60°C to 300°C and high temperature NTC thermistors cover the range 600°C to 1000°C. These thermistors, however, do not usually possess practical resistance values or acceptable stability over the 300°C to 600°C temperature range. By practical resistance values is meant tens of ohms at one end of the range and hundreds of thousands of ohms at the other end of the range. Although some commercially available thermistors intended for use in the range −60°C to 300°C would have practical resistance values above 300°C, their stability above 300°C would not normally be commercially acceptable. The high temperature thermistor would have a resistance of the order of two megohms at around 600°C which increases with decreasing temperature.

A previously known composition disclosed in British Pat. No. 874,882, utilizes a thermistor material formed from a mixture of zirconia and between 2% and 25% by weight of yttria, a specific embodiment containing 15% of yttria and 85% of zirconia. The use of praseodymium oxide in place of yttria was also suggested. By varying the percentage ratio, a minimum specific resistance is obtained at the preferred percentage ratio.

SUMMARY OF THE INVENTION

It is therefore an object of the present invention to provide an improved mixture for a stable negative temperature coefficient thermistor with practical resistance values in the range of 100°C to 600°C, and in particular the range 300° to 600°C.

According to the present invention there is provided a thermistor made from a mixture of between 99% and 50% by weight of praseodymium oxide and 1% to 50% by weight of an oxide of one or more of the following elements — aluminum, zirconium, thorium and hafnium, the thermistor having practical resistance values over the temperature range 100°C to 600°C and good stability. Preferably the composition is 75 to 95%, praseodymium oxide, the remainder being zirconium oxide with or without the addition of up to 4% by weight of indium or gallium oxide.

BRIEF DESCRIPTION OF THE DRAWINGS

FIG. 1 shows the temperature resistance relationships of two different mixtures of materials in accordance with the present invention, and FIG. 2 is a resistance - % composition graph.

Description of the Preferred Embodiment

In order that the invention can be clearly understood, a method of making a thermistor material using a mixture of praseodymium oxide and zirconium oxide will now be described.

EXAMPLE 1

A mixture of 80% by weight of praseodymium oxide and 20% by weight of zirconium oxide are mixed by ball milling together for between 10 and 48 hours in a ceramic mill jar containing water and porcelain mill balls. This mixture is then filtered and dried. Because of high material costs it is expedient to use the material prepared as described above for manufacturing thermistors in the form of beads formed on platinum or platinum alloy leads. The dried powder is mixed with a small quantity of suitable binder to form a slurry of creamy consistency. This slurry is then formed into spheroid beads on two taut parallel platinum or platinum alloy wires held a known distance apart for example 0.25 mm. The beads are dried in air until they are mechanically strong enough to handle, then sintered in air at temperatures between 1200°C – 1500°C for a period of 1 – 24 24 hours, according to the desired resistance/temperature characteristic, this being lower the higher the temperature and the longer it is maintained.

After sintering the beads are cut from the wires in such a way as to allow a suitable length of platinum wire electrode to emerge from the sintered material. The beads are usually coated in a glass forming glaze or are encapsulated in solid glass with electrode wires protruding from the glass. The completed device is thermally treated to stabilize its resistance.

The accompanying drawing of FIG. 1 shows in curve A the effect of temperature on the resistance of a thermistor manufactured from the present material, the graph being plotted in co-ordinates log R vs Temperature. Typical resistance values for a termistor prepared from a mixture of 80% by weight of praseodymium oxide and 20% by weight of zirconium oxide are at 100°C, 333 K ohms; 200°C, 27K ohms; 300°C, 4.6K ohms; 400°C, 1.4K ohms; 500°C, 600 ohms; and 600°C, 300 ohms.

The resistance value at a particular temperature or the temperature coefficient of resistance can be altered within limits by changing either the material composition or by varying the thermal treatment during the thermistor bead sintering stages. For example, the addition of indium or gallium oxides to the mixtures in the order 0–4% by weight has the effect of lowering the resistivity and the temperature coefficient of resistance.

EXAMPLE 2

A thermistor similarly made but with composition 90% praseodymium oxide and 10% zirconium oxide by weight would have a resistance/temperature characteristic as shown in curve B, in FIG. 1.

EXAMPLE 3

A thermistor made in the manner described in Example 1 but with 80% $Pr_6O_{11}$ and 20% ZnO quite unexpectedly also provides a thermistor with similar resistance values. Like results may be obtained with oxides of Cadmium, Mercury, Magnesium and similar types of material when used with Praseodymium oxide in percentage compositions such as those discussed herein.

From tests conducted in investigating the systems described herein and from FIG. 2 it is apparent that a completely unexpected drastic change in electrical properties occurs in the region of 60% $Pr_6O_{11}$ 40% ZrO2 with almost a "step" change of 2½ orders of magnitude in resistivity. The exact position of this "step" is not certain except that it seems to lie between 54% and 67% $Pr_6O_{11}$. In FIG. 2, reference temperature for curve (a) was 100°C, for curve (b) 200°C and curve (c) 750°C. The dashed portions of the curves were obtained by extrapolation and interpolation.

Alternatively aluminum oxide can be added to increase the resistivity and temperature coefficient of resistance. For example the thermistor composition can comprise 60 – 99% by weight of praseodymium with 1 – 40% of either zirconium oxide or thorium oxide or both plus up to 10% of aluminum oxide, preferably 5%.

Although bead thermistors have been described, rod or disc-type thermistors could be made using the compositions described herein.

As a bead device the thermistor material is preferably coated with a ceramic glaze or alternatively encapsulated in solid glass in order to further improve its stability.

Quite unexpectedly the preferred embodiment exhibits resistance values sufficiently high for operation at temperatures up to 600°C yet low enough for operation at 100°C, and a reasonable stability of resistance is achieved up to 600°C.

What is claimed is:

1. A thermistor comprising a mixture of between 99% and 50% by weight of $Pr_6O_{11}$ and 1% to 50% by weight of an oxide of the group of metals consisting of thorium, aluminum, hafnium, zinc, cadmium, mercury and magnesium.

2. The thermistor of claim 1, wherein said $Pr_6O_{11}$ is from 75 to 99% by weight of said mixture.

3. The thermistor of claim 2, wherein said oxide is zinc oxide.

4. The thermistor of claim 2, wherein said oxide is thorium oxide.

5. The thermistor of claim 2, wherein said oxide is aluminum oxide of up to 10% by weight and including a further oxide of zirconium.

6. The thermistor of claim 4, including a further oxide of aluminum of up to 10% by weight.

7. A thermistor comprising a mixture of between 75% and 99% by weight of $Pr_6O_{11}$ and 25% to 1% by weight of zirconium oxide and further including from 0 to 4% by weight of a material selected from the group consisting of indium oxide and gallium oxide.

8. The thermistor of claim 7, wherein said mixture has a negative temperature coefficient of resistance operable in the range of from 100°C to 600°C.

* * * * *